US011348751B2

(12) United States Patent
Wang et al.

(10) Patent No.: US 11,348,751 B2
(45) Date of Patent: May 31, 2022

(54) ELECTRICAL SWITCHING APPARATUS, AND THOMSON COIL ACTUATOR AND DISC MEMBER THEREFOR

(71) Applicant: EATON INTELLIGENT POWER LIMITED, Dublin (IE)

(72) Inventors: Hongbin Wang, Novi, MI (US); Steven Chen, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 569 days.

(21) Appl. No.: 16/223,462

(22) Filed: Dec. 18, 2018

(65) Prior Publication Data

US 2020/0194206 A1 Jun. 18, 2020

(51) Int. Cl.

| | |
|---|---|
| ***H01H 50/44*** | (2006.01) |
| ***H01H 3/54*** | (2006.01) |
| ***H01H 3/46*** | (2006.01) |
| ***H01H 9/00*** | (2006.01) |
| ***H01H 50/20*** | (2006.01) |

(52) U.S. Cl.

CPC ..... *H01H 50/44* (2013.01); *H01H 3/46* (2013.01); *H01H 3/54* (2013.01); *H01H 9/0066* (2013.01); *H01H 50/20* (2013.01)

(58) Field of Classification Search

CPC ..... H01H 3/46; H01H 3/54; H01H 50/20; H01H 50/44; H01H 9/0066; H01H 33/285; H01H 33/6662; H01H 3/222

See application file for complete search history.

(56) References Cited

U.S. PATENT DOCUMENTS

| | | | | |
|---|---|---|---|---|
| 4,272,661 | A | 6/1981 | Dethlefsen | |
| 9,431,184 | B2 * | 8/2016 | Lee | H01H 33/6662 |
| 10,600,593 | B2 * | 3/2020 | Falkingham | H01H 9/20 |
| 11,004,641 | B2 * | 5/2021 | Garcia-Ferre | H01H 9/40 |
| 2020/0258704 | A1 * | 8/2020 | Yu | H01H 33/66207 |
| 2020/0402752 | A1 * | 12/2020 | Leccia | H01H 33/6662 |
| 2020/0411261 | A1 * | 12/2020 | Zhou | H01H 33/285 |
| 2021/0066012 | A1 * | 3/2021 | Salinas | H01H 50/18 |
| 2022/0068532 | A1 * | 3/2022 | Ashtekar | H01F 7/081 |

FOREIGN PATENT DOCUMENTS

| | | | |
|---|---|---|---|
| DE | 10 2012 224277 | A1 | 6/2014 |
| JP | HII 25817 | A | 1/1999 |
| WO | 2014/048483 | A1 | 4/2014 |

OTHER PUBLICATIONS

European Patent Office, "International Search Report and Written Opinion" of corresponding PCT/EP2019/025459, Mar. 27, 2020, 14 pp.

* cited by examiner

*Primary Examiner* — Bernard Rojas
(74) *Attorney, Agent, or Firm* — Eckert Seamans Cherin & Mellott, LLC

(57) ABSTRACT

A disc member is for a Thomson coil actuator of an electrical switching apparatus. The Thomson coil actuator has at least one generally planar coil. The disc member includes at least one annular-shaped conductive member structured to be driven by the coil, and a structural support member directly coupled to the conductive member.

19 Claims, 4 Drawing Sheets

ELECTRICAL SWITCHING APPARATUS, AND THOMSON COIL ACTUATOR AND DISC MEMBER THEREFOR

BACKGROUND

Field

The disclosed concept relates generally to electrical switching apparatus such as, for example, vacuum circuit breakers. The disclosed concept also relates to Thomson coil actuators for electrical switching apparatus. The disclosed concept further relates to repulsive disc members for Thomson coil actuators.

Background Information

Electrical switching apparatus for electrical systems have to be able to disconnect electrical faults. For high voltage, and high and fast-rising short-circuit current, fast current interruption is generally necessary. Two technologies commonly employed for fast and reliable switching are the arc extinguishing media and the actuator. Vacuum circuit interrupters, for example, have the advantages of being relatively green, reliable, and low cost. Spring, pneumatic, hydraulic, and magnetic actuation mechanisms are commonly used for actuation purposes in electrical switching apparatus.

Thomson coil based electromagnetic actuators have the advantages of being fast in terms of opening operation, have less moving parts and are generally reliable. Next generation electrical switching apparatus such as, for example, vacuum circuit breakers, employ Thomson coil actuators to achieve actuating separable electrical contacts inside a vacuum bottle for challenging circuit protection needs in high voltage and current applications such as HVDC circuit and generator breakers. Specifically, the Thomson coil actuator drives the pushing rods up and down, which in turn, allows a movable electrical contact of the electrical switching apparatus to move into and out of engagement with a stationary electrical contact. The Thomson coil actuator commonly includes high voltage energy supply, storage, and control unit with the capacitor banks and power semiconductor switches, at least one generally planar coil and a disc member placed in close proximity and parallel to the planar coils. In order to achieve ultra-high actuation speed with minimum power supply due to size and cost constraints, the disc member must be lightweight while also having strong mechanical and thermal rigidity for robust operation.

It is desirable to provide an improved electrical switching apparatus, and Thomson coil actuator and disc member therefor.

SUMMARY

These needs and others are met by embodiments of the invention, which are directed to an electrical switching apparatus, and Thomson coil actuator and disc member therefor.

As one aspect of the disclosed concept, a disc member for a Thomson coil actuator of an electrical switching apparatus is provided. The Thomson coil actuator has at least one generally planar coil. The disc member comprises at least one annular-shaped conductive member structured to be driven by the at least one coil, and a structural support member directly coupled to the at least one conductive member.

As another aspect of the disclosed concept, a Thomson coil actuator of an electrical switching apparatus is provided. The Thomson coil actuator comprises at least one generally planar coil; and a disc member comprising at least one annular-shaped conductive member structured to be driven by the at least one coil, and a structural support member directly coupled to the at least one conductive member.

As another aspect of the disclosed concept, an electrical switching apparatus comprises a first electrical contact, a second electrical contact, a pushing rod coupled to the second electrical contact in order to move the second electrical contact into and out of engagement with the first electrical contact, and a Thomson coil actuator. The Thomson coil actuator comprises at least one generally planar coil, wherein the pushing rod extends through the at least one planar coil, and a disc member fixedly attached to the pushing rod. The disc member comprises at least one annular-shaped conductive member structured to be driven by the at least one coil, and a structural support member directly coupled to the at least one conductive member.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the singular form of "a", "an", and "the" include plural references unless the context clearly dictates otherwise. Still further, as used herein, the term "number" shall mean one or an integer greater than one (e.g., a plurality).

As employed herein, the term "coupled" shall mean that two or more parts are joined together directly or joined through one or more intermediate parts. Furthermore, as employed herein, the phrase "directly coupled" shall mean that two or more parts are joined together directly, without any intermediate parts being disposed therebetween at the point or location of the connection. "Directly coupled" may include one part being overmolded onto another part, and may also include one part being embedded in or on another part. Two parts being "directly coupled" together may be directly affixed to one another.

Example 1

Figure 1:
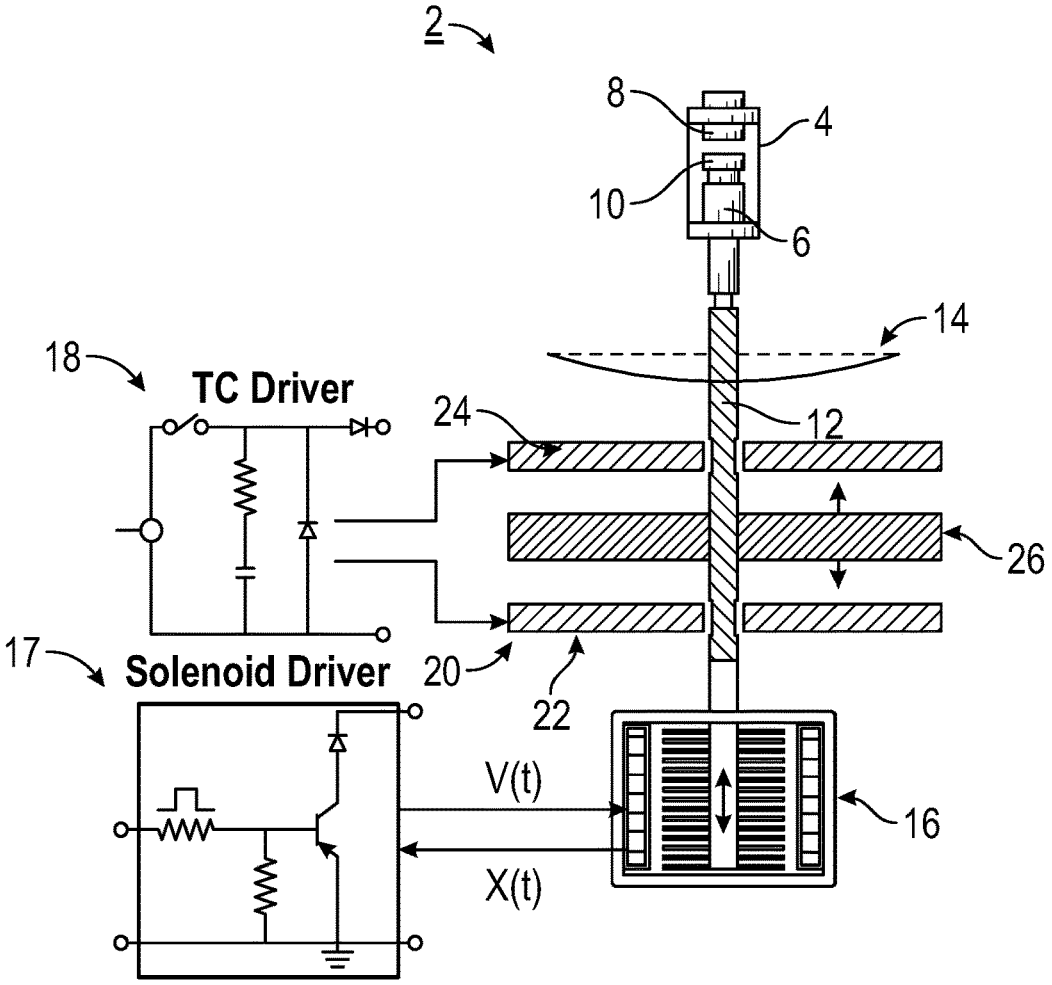
FIG. 1 is a simplified elevation section view of an electrical switching apparatus, and Thomson coil actuator and disc member therefor, in accordance with one non-limiting embodiment of the disclosed concept.
Figure 2:
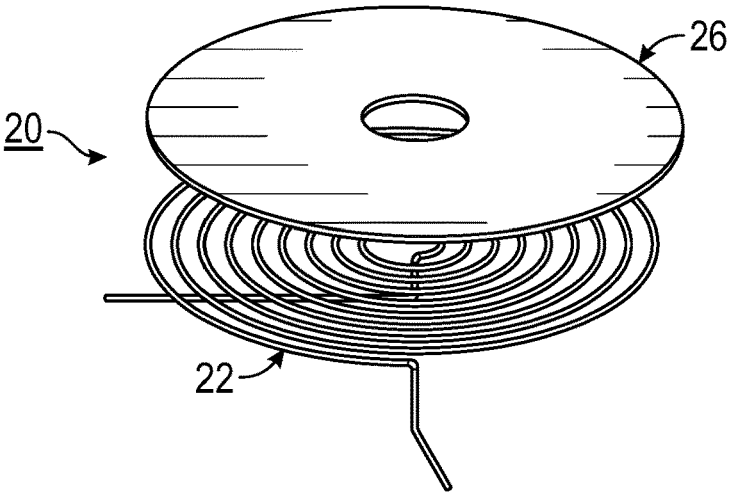
FIG. 2 is an isometric view of the Thomson coil actuator of FIG. 1, shown without the top coil in order to see internal structure.

FIG. 1 is a simplified view of an electrical switching apparatus (e.g., without limitation, vacuum circuit breaker 2), and Thomson coil actuator 20 (also partially shown in FIG. 2) and disc member 26 therefor, in accordance with one non-limiting embodiment of the disclosed concept. As shown, the circuit breaker 2 includes, in addition to the Thomson coil actuator 20, a tubular ceramic member 4, a bellows member 6 located internal with respect to the ceramic member 4, a pair of separable electrical contacts (e.g., stationary electrical contact 8 and movable electrical contact 10), a pushing rod 12 coupled to the movable electrical contact 10 in order to move the movable electrical contact into and out of engagement with the stationary electrical contact 8, a disk spring 14 coupled to the pushing rod 12, a solenoid 16 coupled to the pushing rod 12, a solenoid driver 17 electrically connected to the solenoid 16, and a Thomson coil driver 18 electrically connected to the Thomson coil actuator 20. The disk spring 14 functions to maintain an open or closed position of the electrical contacts 8,10 once the Thomson coil actuator 20 has been actuated. The Thomson coil actuator 20 includes at least one generally planar coil 22,24 and the disc member 26. The planar coils 22,24 each have a thru hole for receiving the pushing rod 12 therethrough. The disc member 26 is fixedly coupled to the pushing rod 12.

The solenoid 16 functions to introduce electrical current into the coils 22,24 to cause them to drive the disc member 26 up and down, thereby assisting the Thomson coil actuator 20 in closing and opening the electrical contacts 8,10, respectively.

Figure 3A:
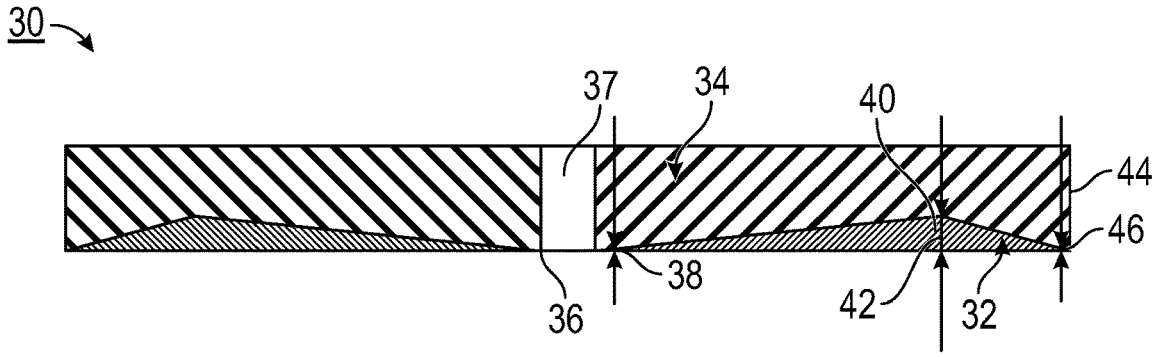
FIG. 3A is a section view of a disc member that may be substituted into the electrical switching apparatus and Thomson coil actuator therefor of FIG. 1, in accordance with one non-limiting embodiment of the disclosed concept.

FIG. 3A is a section view of a disc member 30 that may be substituted into the circuit breaker 2 and Thomson coil actuator 20 therefor of FIG. 1, in place of the disc member 26, in accordance with one non-limiting embodiment of the disclosed concept. When the disc member 30 is substituted into the circuit breaker 2, the top coil 24 may be removed in order to provide for a single-action circuit breaker. In accordance with the disclosed concept, the disc member 30 includes an annular-shaped conductive member 32 and a structural support member 34 directly coupled to the conductive member 32. The conductive member 32 may be made of metal, optionally sheet metal, and is structured to be driven by the bottom coil 22. Specifically, when a current is introduced to the bottom coil 22 by the Thomson coil driver 18, an electromagnetic force from the bottom coil 22 acts on and drives the conductive member 32, thereby allowing the circuit breaker 2 to be actuated.

Additionally, in accordance with the disclosed concept, the structural support member 34 may be an insulative member that is relatively lightweight (e.g., less dense than the conductive member 32). In one example embodiment, the structural support member 34 is a lightweight material such as a non-metallic plastic composite, or a lightweight (e.g., as compared to the conductive member 32) metallic material such as an aluminum or magnesium alloy. Furthermore, the structural support member 34 is structured to provide beneficial support to the disc member 30 to allow for robust operation. Although the disc member 30 is not made entirely of a uniformly conductive component, as is the case with prior art disc members (not shown) for Thomson coil actuators, the conductive member 32 is structured so as to allow for proper operation in the circuit breaker 2.

More specifically, the conductive member 32 has an edge portion 36 defining a central thru hole 37. The conductive member 32 further has a first thickness 38 proximate the edge portion 36 and a second thickness 42 proximate a location 40 radially outward of the edge portion 36. As shown, the second thickness 42 is greater than the first thickness 38. Furthermore, the conductive member 32 has a third thickness 46 proximate a periphery 44 of the disc member 30, and the third thickness 46 is less than the second thickness 42. In one example embodiment, the second thickness 42 is a maximum thickness of the conductive member 32, and the location 40 is located closer to the periphery 44 than the edge portion 36. Furthermore, in one example embodiment the conductive member 32 may constantly become thicker from the edge portion 36 to the location 40, and may constantly become less thick from the location 40 to the periphery 44.

Accordingly, in addition to being comprised of two members (e.g., conductive and structural support members 32,34) to reduce the weight of the disc member 30, the geometry of the conductive member 32 advantageously allows for a further reduction in weight, while still ensuring that actuation of the Thomson coil actuator is done rapidly. Specifically, the inventors have discovered that when the Thomson coil actuator 20 is actuated, the eddy current is more heavily distributed, or has a higher current density, at a radial location proximate the location 40. Accordingly, by making the conductive member 32 more thick in this region, the conductive member 32 can more intensely be driven by the coil 22 (i.e., due to the relatively high current density). Additionally, by tapering the thickness, e.g., by making the first and third thicknesses 38,46 less than the second thickness 42, the weight of the disc member 30 can be kept relatively low. This tactic of optimizing the thickness of the conductive material as a step function of disc radius, or trapezoid, makes it possible to significantly reduce the weight of moving parts. Furthermore, the usage of the relatively lightweight (i.e., but still robust under relatively high actuation stress) structural support member 34 also allows the disc member 30 to actuate quickly. As a result, Thomson coil drivers and batteries do not need to work as much during opening and closing of the circuit breaker. This allows said parts to last longer, thereby reducing costs. Additionally, the Thomson coil actuator 20 allows for a relatively compact design, better thermal and structural durability, and more powerful actuation force.

Example 2

Figure 3B:
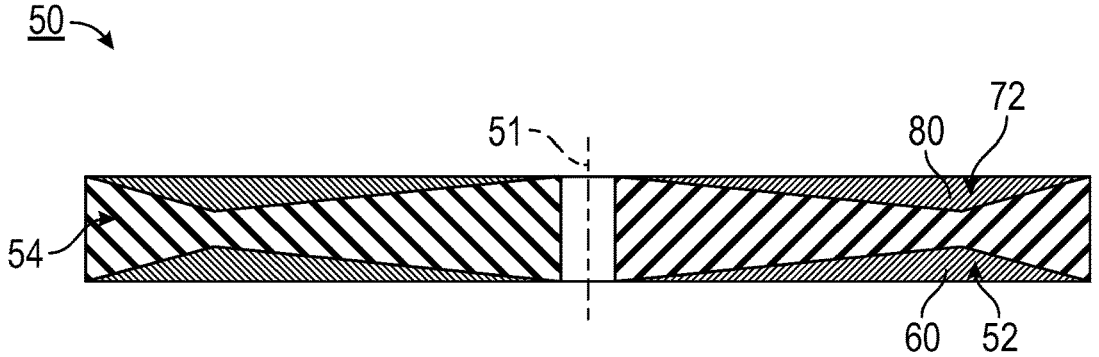
FIG. 3B is a section view of another disc member that may be substituted into the electrical switching apparatus and Thomson coil actuator therefor of FIG. 1, in accordance with another non-limiting embodiment of the disclosed concept.

FIG. 3B is a section view of a disc member 50 that may be substituted into the vacuum circuit breaker 2 and Thomson coil actuator 20 therefor of FIG. 1, in place of the disc member 26, in accordance with another non-limiting embodiment of the disclosed concept. This disc member 50 is structured similar to the disc member 30, and like reference numerals represent like features. The conductive member 52 and the structural support member function the same as the conductive member 32 and structural support member 34 of the disc member 30. However, as shown, the disc member 50 further includes another annular-shaped conductive member 72 directly coupled to the structural support member 54 and spaced from the conductive member 52. The structural support member 54 extends between and connects the conductive members 52,72. As shown, the conductive member 72 is shaped the same as the conductive member 52, but is positioned such that its planar side is distal from the conductive member 52. Furthermore, the location 60 of the first conductive member 52 is spaced substantially the same distance from a central axis 51 of the disc member 50 as the location 80 of the second conductive member 72. As such, when the disc member 50 is substituted into the circuit breaker 2, in addition to affording benefits such as being relatively lightweight, the disc member 50 will allow the circuit breaker 2 to still be double action. Specifically, the first conductive member 52 will be structured to face and be driven by the first coil 22, and the second conductive member 72 will be structured to face and be driven by the second coil 24.

Example 3

Figure 3C:
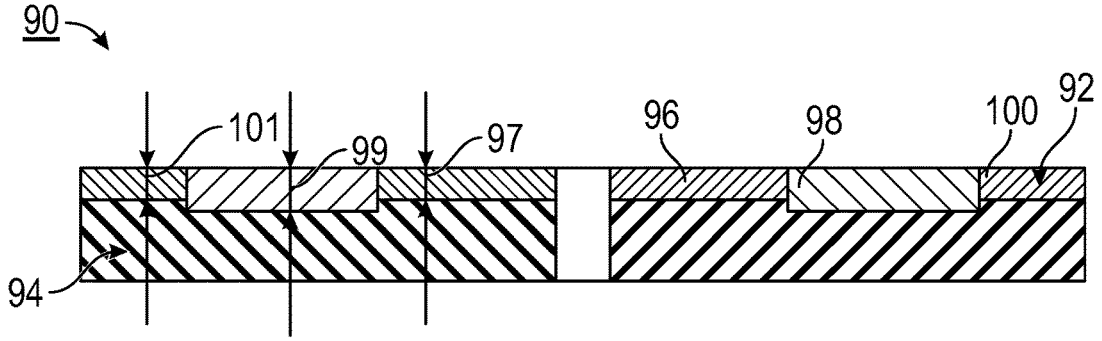
FIG. 3C is a section view of another disc member that may be substituted into the electrical switching apparatus and Thomson coil actuator therefor of FIG. 1, in accordance with another non-limiting embodiment of the disclosed concept.

FIG. 3C is a section view of a disc member 90 that may be substituted into the vacuum circuit breaker 2 and Thomson coil actuator 20 therefor of FIG. 1, in place of the disc member 26, in accordance with another non-limiting embodiment of the disclosed concept. The disc member 90 is structured similar to the disc member 30, and like reference numerals represent like features. However, when the disc member 90 is employed, the bottom coil 22 may be removed. As shown, the conductive member 92 includes first, second, and third annular-shaped portions 96,98,100 each made of different materials that are directly coupled to the structural support member 94. The second annular-shaped portion 98 is located external with respect to the first portion 96, and is connected to the first and third portions 96,100 and located therebetween. In one example embodiment the first and third portions 96,100 are made of aluminum and the second portion 98 is made of copper. As current is more heavily generated in the region proximate the second portion 98, employing copper here allows for more reliable actuation, whereas employing aluminum with the first and third portions 96,100 provides advantages in terms of weight reduction (e.g., the first and third portions 96,100 may be less dense than the second portion 98), thereby allowing for relatively fast actuation.

Additionally, the weight of the disc member 90 is further controlled via thicknesses. Specifically, each of the first, second, and third portions 96,98,100 has a corresponding thickness 97,99,101, and the thickness 99 of the second portion 98 is greater than the thickness 97,101 of the first and third portions 96,100.

Example 4

Figure 3D:
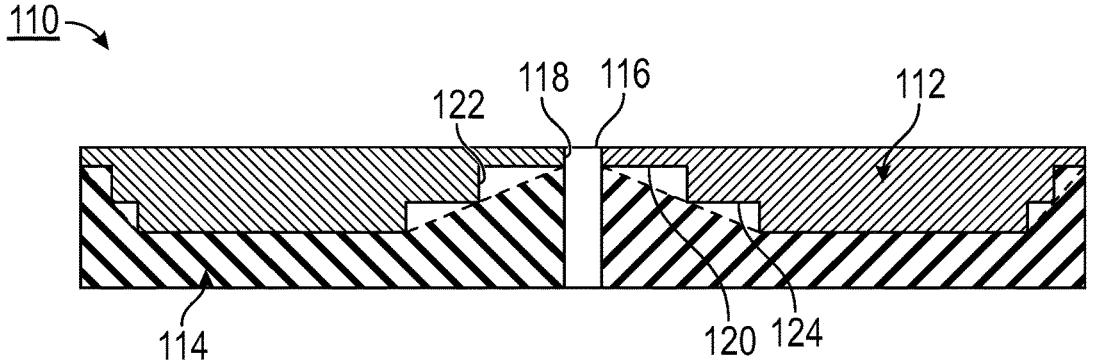
FIG. 3D is a section view of another disc member that may be substituted into the electrical switching apparatus and Thomson coil actuator therefor of FIG. 1, in accordance with another non-limiting embodiment of the disclosed concept.

In yet another example embodiment of the disclosed concept, shown in FIG. 3D, a conductive member 112 of a disc member 110 for the circuit breaker 2 has a first cylindrical-shaped surface 118 extending from the edge portion 116, a first planar surface 120 extending radially outward from the first cylindrical-shaped surface 118, a second cylindrical-shaped surface 122 extending from and being located substantially perpendicular to the first planar surface 120, and a second planar surface 124 extending radially outward from the second cylindrical-shaped surface 122. It will be appreciated that machining the conductive member 112 in this manner may be relatively simple.

Example 5

Figure 4A:
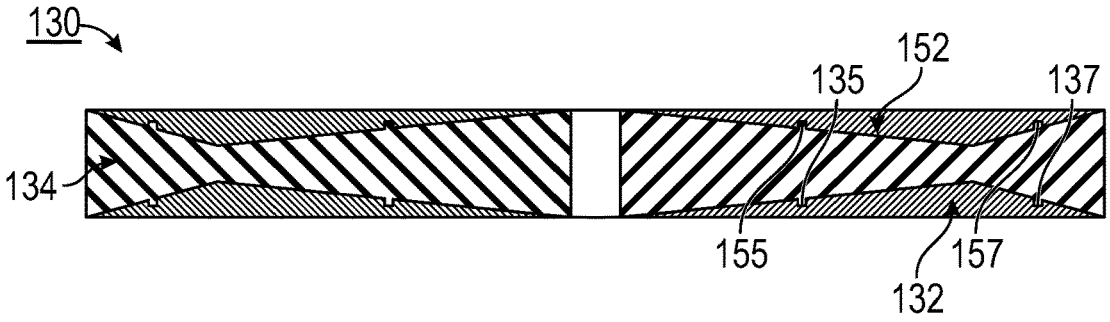
FIG. 4A is a section view of another disc member that may be substituted into the electrical switching apparatus and Thomson coil actuator therefor of FIG. 1, in accordance with another non-limiting embodiment of the disclosed concept.
Figure 4B:
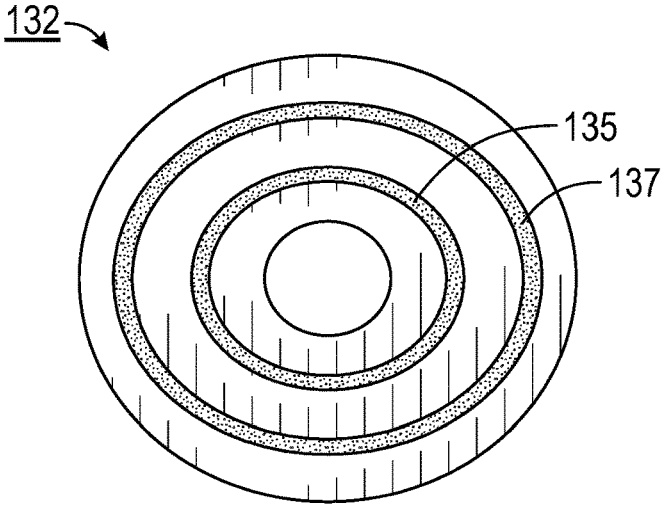
FIG. 4B is a top view of a conductive member for the disc member of FIG. 4A.
Figure 4C:
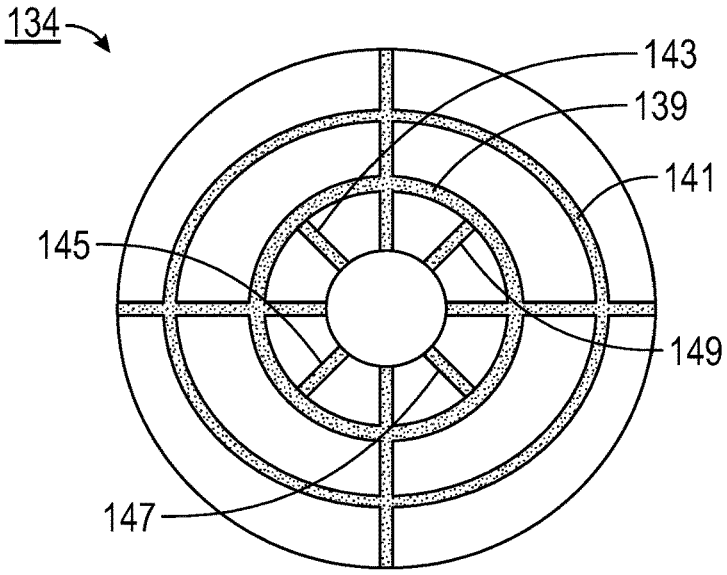
FIG. 4C is a top view of a structural support member for the disc member of FIG. 4A.

In yet another example embodiment of the disclosed concept, shown in FIGS. 4A-4C, a disc member 130 for the circuit breaker 2 has first and second conductive members 132,152 each having at least one groove (e.g., without limitation, annular-shaped internal grooves 135,137,155, 157). See, for example, the top view of the conductive member 132, shown in FIG. 4B. In order to provide an additional reduction in weight, the structural support member 134 has at least one rib (e.g., without limitation, annular ribs 139,141) located in the grooves 135,137,155,157 in order to directly couple the conductive members 132,152 to the structural support member 134. Furthermore, as shown in the top view of the structural support member 134 in FIG. 4C, the structural support member 134 further includes a number of other ribs (e.g., four of the other ribs 143,145, 147,149 are shown in FIG. 4C) extending from at least one of the annular ribs 139,141. In this manner, the structural support member 134 is still able to provide necessary structural support to the disc member 130 by virtue of the ribs 139,141,143,145,147,149 extending between the conductive members 132,152, but further reduces weight by eliminating structural support member material.

Example 6

Figure 5:
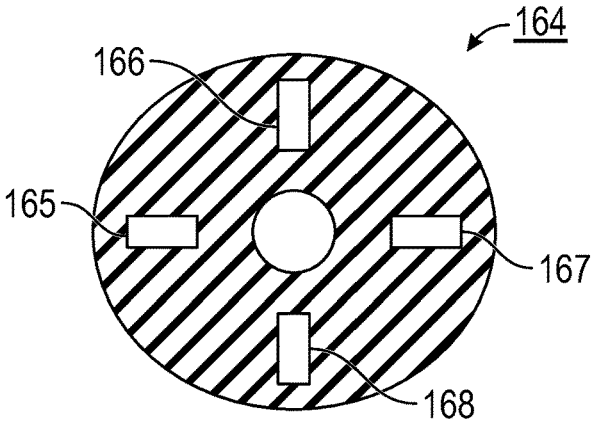
FIG. 5 is a top section view of a structural support member that may be substituted into the electrical switching apparatus and Thomson coil actuator therefor of FIG. 1, in accordance with another non-limiting embodiment of the disclosed concept.

In yet another example embodiment of the disclosed concept, shown in a top section view of FIG. 5, a structural support member 164 for a disc member of a Thomson coil actuator has a number of pockets (i.e., voids) 165,166,167, 168 in order to reduce weight.

Example 7

Figure 6A:
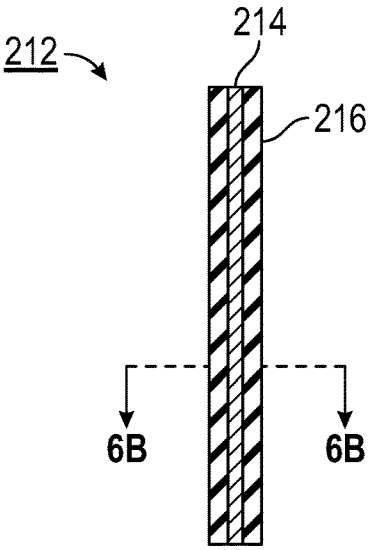
FIGS. 6A and 6B are front section and top section views, respectively, of a pushing rod for the electrical switching apparatus and Thomson coil actuator therefor of FIG. 1.
Figure 6B:
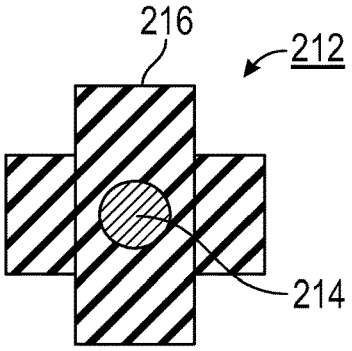

In yet another example embodiment, shown in FIGS. 6A and 6B, a pushing rod 212 is provided that may be substituted into the vacuum circuit breaker 2 and Thomson coil actuator 20 therefor of FIG. 1, for the pushing rod 12. As shown in FIGS. 6A and 6B, the pushing rod 212 may include an elongated internal component 214 and an elongated external component 216 directly coupled to and located external with respect to the internal component 214. In one example embodiment, the internal component 214 is made of a metallic material, and the external component 216 is made of a less dense metallic, or a non-metallic material that is less dense than the internal component 214. Furthermore, in one example embodiment, the external component 216 and the structural support member of a disc member (e.g., structural support members 34,54,94,114) are a unitary component made from a single piece of material (e.g., an insulative material such as a thermoplastic material). It will be appreciated that by making a external component 216 non-metallic, and in one example embodiment less dense than the internal component 214, actuation of the Thomson coil actuator, which is connected to the pushing rod via the disc members, can advantageously be much faster.

Example 8

Figure 7:
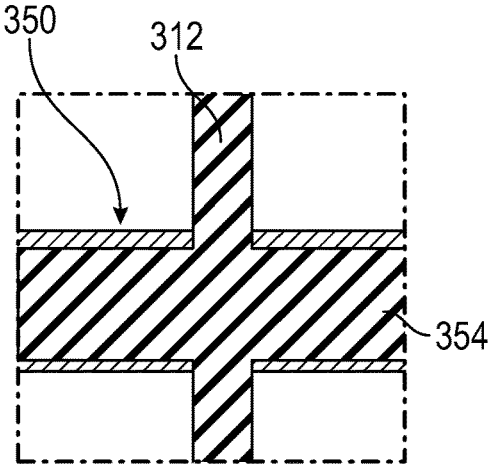
FIG. 7 is a front section view of a portion of another disc member and pushing rod that may be substituted into the electrical switching apparatus and Thomson coil actuator therefor of FIG. 1, in accordance with another non-limiting embodiment of the disclosed concept.

In yet another example embodiment, shown in FIG. 7, the pushing rod 312 is made entirely of a non-metallic material, thereby further reducing weight and increasing actuation speeds. Further yet, the pushing rod 312 and the structural support member 354 of the disc member 350 may be made of a unitary component made from a single piece of material.

Accordingly, it will be appreciated that the disclosed concept provides for an improved (e.g., without limitation, more rapidly actuated, longer lasting) electrical switching apparatus 2, and Thomson coil actuator 20 and disc member 30,50,90,110,130,350 therefor, in which, among other benefits, disc members 30,50,90,110,130,350 are provided with structural support members 34,54,94,114,134,354 to reduce weight, while maintaining structural integrity.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof

What is claimed is:

1. A disc member for a Thomson coil actuator of an electrical switching apparatus, said Thomson coil actuator comprising at least one generally planar coil, said disc member comprising:

at least one annular-shaped conductive member structured to be driven by said at least one coil; and a structural support member directly coupled to said at least one conductive member, wherein said at least one conductive member has an edge portion defining a central thru hole, wherein said at least one conductive member has a first thickness proximate the edge portion and a second thickness proximate a location radially outward of the edge portion, and wherein the second thickness is greater than the first thickness.

2. The disc member of claim 1 wherein said at least one conductive member further has a third thickness proximate a periphery of said disc member; and wherein the third thickness is less than the second thickness.

3. The disc member of claim 2 wherein said at least one conductive member comprises a first cylindrical-shaped surface extending from the edge portion, a first planar surface extending radially outward from the first cylindrical-shaped surface, a second cylindrical-shaped surface extending from and being disposed substantially perpendicular to the first planar surface, and a second planar surface extending radially outward from the second cylindrical-shaped surface.

4. The disc member of claim 2 wherein said at least one conductive member constantly become more thick from the edge portion to the location; and wherein said at least one conductive member constantly becomes less thick from the location to the periphery.

5. The disc member of claim 2 wherein said at least one conductive member further has a maximum thickness; wherein the maximum thickness is the second thickness; and wherein the location is disposed closer to the periphery than the edge portion.

6. The disc member of claim 2 wherein said at least one generally planar coil comprises a first planar coil and a second planar coil; wherein said at least one conductive member comprises a first conductive member structured to face and be driven by said first planar coil, and a second conductive member structured to face and be driven by said second planar coil; wherein said first conductive member is spaced from said second conductive member; and wherein said structural support member extends between and connects said first conductive member to said second conductive member.

7. The disc member of claim 6 wherein the location of said first conductive member is spaced substantially the same distance from a central axis of said disc member as the location of said second conductive member.

8. The disc member of claim 2 wherein said at least one conductive member has at least one groove; and wherein said structural support member comprises at least one rib disposed in said at least one groove in order to directly couple said at least one conductive member to said structural support member.

9. The disc member of claim 8 wherein said at least one groove comprises a first annular groove and a second annular groove; wherein said at least one rib comprises a first annular rib and a second annular rib each disposed in a corresponding one of the first and second annular grooves; and wherein said at least one rib further comprises at least one other rib extending from at least one of said first annular rib and said second annular rib.

10. The disc member of claim 1 wherein said at least one conductive member comprises a first annular-shaped portion and a second annular-shaped portion connected to said first portion; wherein the first portion is made of a first material; and wherein the second portion is made of a second material different than the first material.

11. The disc member of claim 10 wherein said at least one conductive member further comprises a third annular-shaped portion connected to said second annular-shaped portion; wherein said second annular-shaped portion is disposed between said first annular-shaped portion and said third annular-shaped portion; and wherein said third annular-shaped portion is made of a third material different than the first and second materials.

12. The disc member of claim 10 wherein said second annular-shaped portion is disposed external with respect to said first annular-shaped portion; wherein said first annular-shaped portion has a first thickness; and wherein said second annular-shaped portion has a second thickness greater than the first thickness.

13. The disc member of claim 1 wherein said structural support member has a number of pockets in order to reduce weight.

14. A Thomson coil actuator of an electrical switching apparatus, said Thomson coil actuator comprising:

at least one generally planar coil; and a disc member comprising:

at least one annular-shaped conductive member structured to be driven by said at least one coil, and a structural support member directly coupled to said at least one conductive member, wherein said at least one conductive member has an edge portion defining a central thru hole, wherein said at least one conductive member has a first thickness proximate the edge portion and a second thickness proximate a location radially outward of the edge portion, and wherein the second thickness is greater than the first thickness.

15. The Thomson coil actuator of claim 14 wherein said at least one generally planar coil comprises a first planar coil and a second planar coil; wherein said at least one conductive member comprises a first conductive member structured to face and be driven by said first planar coil, and a second conductive member structured to face and be driven by said second planar coil; wherein said first conductive member is spaced from said second conductive member; and wherein said structural support member extends between and connects said first conductive member to said second conductive member.

16. An electrical switching apparatus comprising:

a first electrical contact;

a second electrical contact;

a pushing rod coupled to said second electrical contact in order to move said second electrical contact into and out of engagement with said first electrical contact; and a Thomson coil actuator comprising:

at least one generally planar coil, said pushing rod extending through said at least one planar coil, and a disc member fixedly attached to said pushing rod, said disc member comprising:

at least one annular-shaped conductive member structured to be driven by said at least one coil, and a structural support member directly coupled to said at least one conductive member, wherein said at least one conductive member has an edge portion defining a central thru hole, wherein said at least one conductive member has a first thickness proximate the edge portion and a second thickness proximate a location radially outward of the edge portion, and wherein the second thickness is greater than the first thickness.

17. The electrical switching apparatus of claim 16 wherein said pushing rod comprises an elongated internal component and an elongated external component directly coupled to and disposed external with respect to said internal component; wherein said internal component is made of a metallic material; wherein said external component is made of a non-metallic material; and wherein said structural support member of said disc member and said external component of said pushing rod are a unitary component made from a single piece of material.

18. The electrical switching apparatus of claim 16 wherein said pushing rod and said structural support member of said disc member are a unitary component made from a single piece of material.

19. The electrical switching apparatus of claim 16 wherein said structural support member is an insulative member; and wherein said electrical switching apparatus is a vacuum circuit breaker.

* * * * *